US005592749A

United States Patent [19]

Trimmer

[11] Patent Number: 5,592,749

[45] Date of Patent: Jan. 14, 1997

[54] HANDS-FREE HAIR DRYER

[76] Inventor: Karen Trimmer, 212 Walnut St., Little Rock, Ark. 72205

[21] Appl. No.: 500,776

[22] Filed: Jul. 11, 1995

[51] Int. Cl.[6] ..... F26B 19/00

[52] U.S. Cl. ..... 34/97; 219/541; 248/160; 392/379; 439/210

[58] Field of Search ..... 34/96, 97; 219/526, 219/541; 392/379, 380, 381, 383, 384, 472, 478; 439/191, 192, 195, 210; 248/160, 276.1

[56] References Cited

U.S. PATENT DOCUMENTS

| | | | |
|---|---|---|---|
| 3,584,822 | 6/1971 | Oram et al. | 248/160 |
| 4,250,800 | 2/1981 | Brockmeyer | 439/195 |
| 4,462,649 | 7/1984 | Medford et al. | 439/192 |
| 4,712,313 | 12/1987 | Gettleman | 34/97 |
| 4,972,607 | 11/1990 | Lagace | 34/97 |
| 5,279,048 | 1/1994 | Lawall et al. | 34/90 |
| 5,313,716 | 5/1994 | Wolfe | 34/90 |
| 5,386,644 | 2/1995 | Lawall et al. | 34/90 |

FOREIGN PATENT DOCUMENTS

| | | | |
|---|---|---|---|
| 1177832 | 9/1964 | Germany | 248/160 |

*Primary Examiner*—Noah P. Kamen
*Attorney, Agent, or Firm*—Gary N. Speed

[57] ABSTRACT

The present invention is a hair dryer apparatus combination designed to allow for detachable and interchangeable arms and bases to hold an electric hair dryer for hands free operation in a variety of situations.

14 Claims, 6 Drawing Sheets

HANDS-FREE HAIR DRYER

I. Cross-references to Related Applications (if any), None

II. Statement as to rights to inventions made under federally sponsored research and development (if any). None III. Background of the Invention A. Field of Invention The present invention relates to electric hair dryers generally and, more particularly, to an electric hair dryer and to detachable and interchangeable accessories for an electric hair dryer which include a positioning arm for adjustably directing hot air toward the head of a user.

B. Description of the Related Art

A wide variety of electric hair dryers are currently available in the market. Portable electric hair dryers typically include a heating element and a fan contained in a pistol-shaped housing. A major disadvantage of such hair dryers is that they require the user to hold the device with one hand. A device allowing the user to use the hand to brush or manipulate the hair while drying would be advantageous. However, retaining the portability of the hair dryer is also important and desirable.

U.S. Pat. No. 5,279,048 discloses a hands free hair dryer and hair dryer accessory that uses a hollow hose to direct hot air from the body of the hair dryer to the user.

U.S. Pat. No. 5,386,644 discloses a similar hands free hair dryer and hair dryer accessory that uses an air-conveying means to direct hot air from the body of the hair dryer to the user. Both U.S. Pat. Nos. 5,279,048 and 5,386,644 use a detachable flexible structure to conduct the hot air after it passes over the heating element.

U.S. Pat. No. 5,313,716 discloses an apparatus allowing the user's hair to hang vertically over a heating element or other means for drying the user's hair. The apparatus includes a means for supporting the user, such as a chair.

U.S. Pat. No. 4,712,313 discloses spring-tensioned extendible arm with a clamp to grasp the barrel of a removable portable hair dryer.

IV. Brief Summary of the Invention

The present invention is a combination of devices designed to allow the user to position a detachable electric hair dryer head using a flexible arm that is detachably mounted to a base. All electrical connections are made through the flexible arm and base to hide them and eliminate the unsightly cord extending from the hair dryer head. The base may be a table-top base, surface-mount wall unit, a flush-mount wall unit or a floor unit. The electric hair dryer head may also be detached from the flexible arm for traveling and used with a separate power cord.

One object of the present invention is to provide a flexible positioning device for an electric hair dryer to enable the user to use the hair dryer on a hands free basis. Another object of the present invention is to create an interlocking system of accessories for mounting the hair dryer that are aesthetically attractive.

These and other objects of the invention will be apparent to those skilled in this art from the following detained description of a preferred embodiment of the invention.

V. Brief Description of the Drawings The invention will be further described in connection with the accompanying drawings, in which.

VI. Reference Numerals in Drawings

Figure 1:
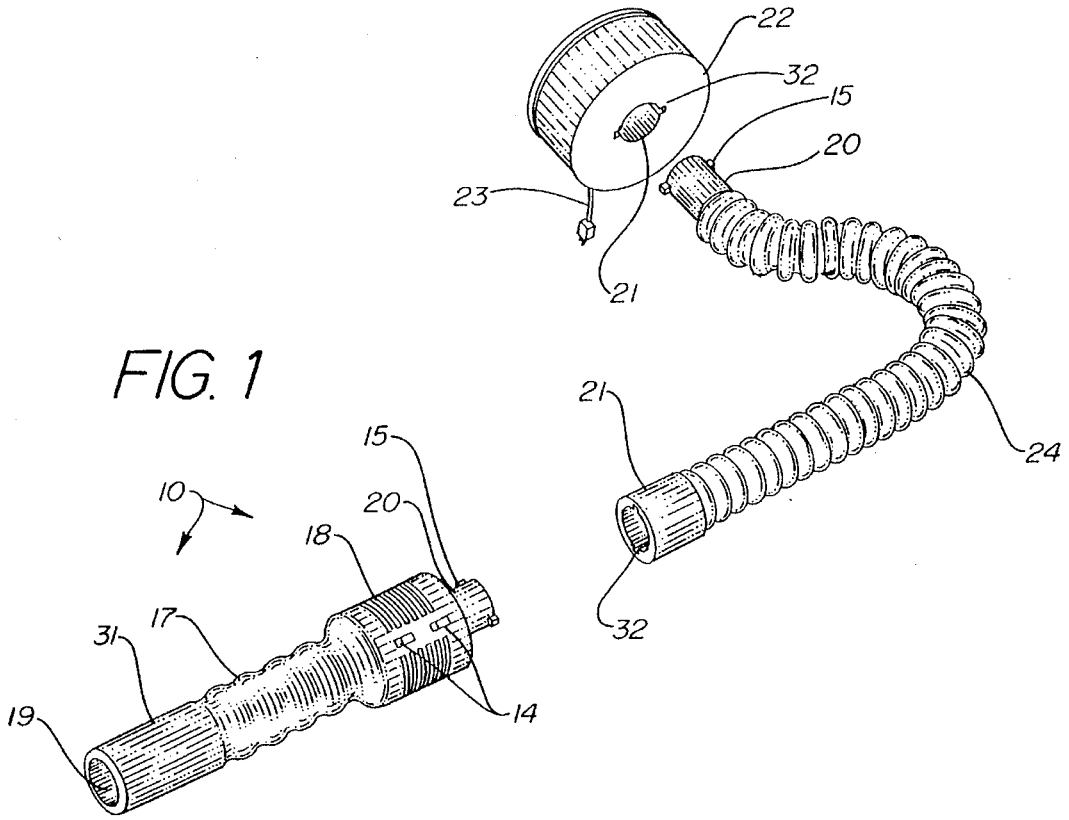
FIG. 1 is a perspective view of one embodiment of the invention, showing the hair dryer head, the flexible arm and the surface-mount base.
Figure 2:
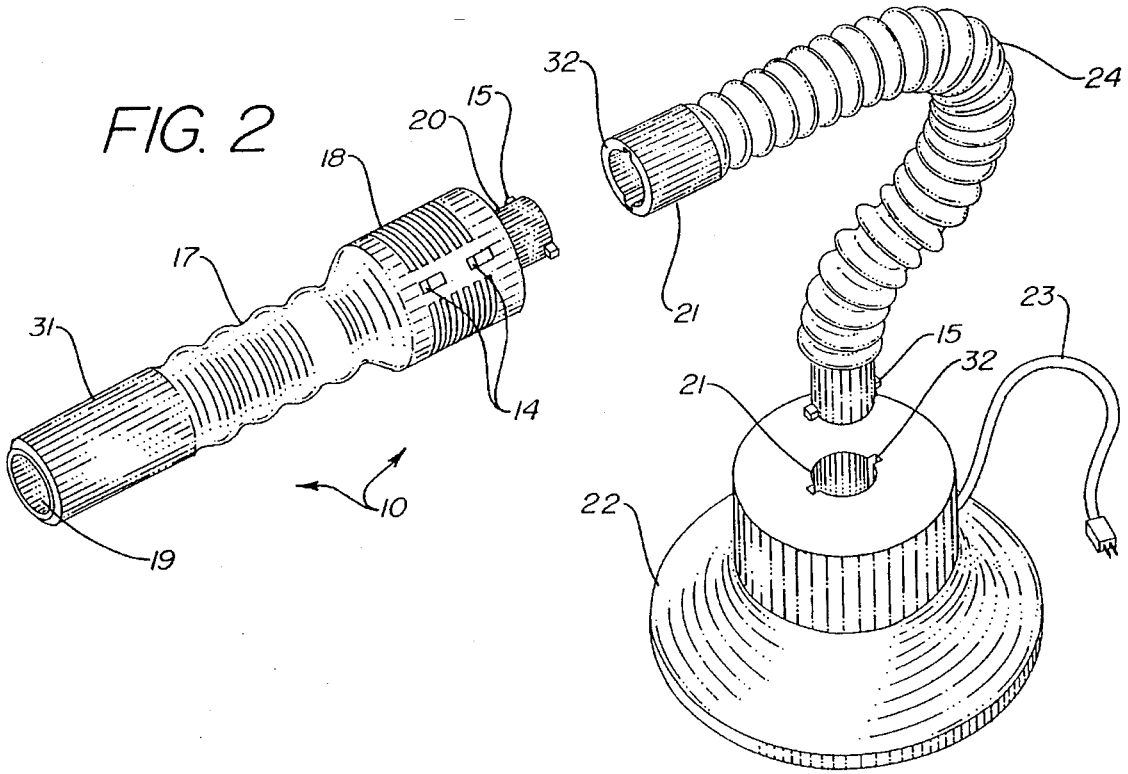
FIG. 2 is a perspective view of another embodiment of the invention, showing the hair dryer head, the flexible arm and the table top base.
Figure 3:
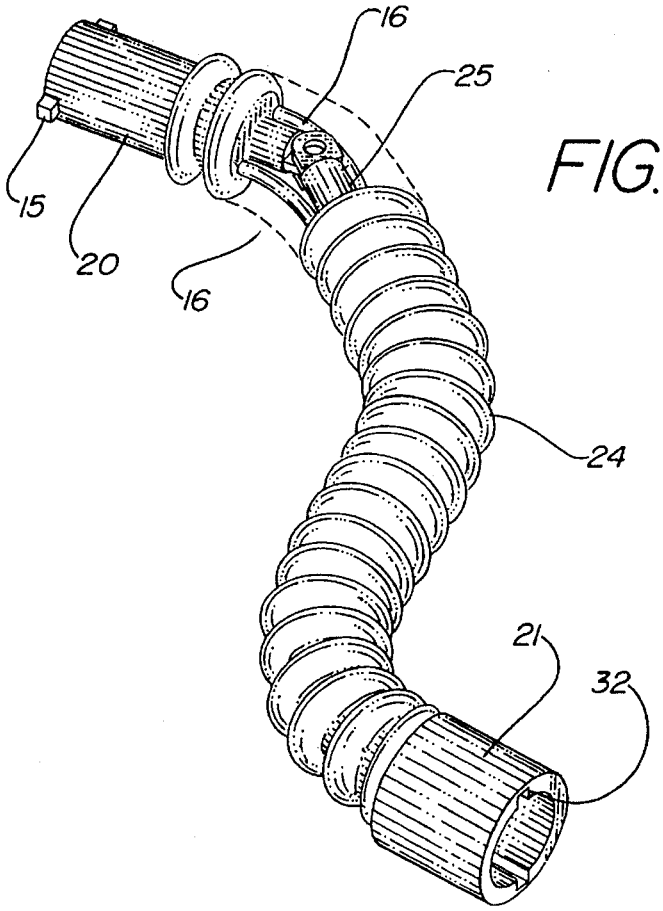
FIG. 3 is a perspective view of another embodiment of the flexible arm with a central flexible spine.

The parts identified in the drawings include the following:

10 electric hair dryer head;
11 motor;
12 fan;
13 heating element;
14 switch;
15 electrical contact;
16 wire;
17 grip;
18 air intake;
19 air exhaust;
20 male connector;
21 female connector;
22 base;
23 power cord;
24 hollow flexible arm;
25 support spine;
26 face plate;
27 protective cover;
28 wall;
29 pivot arm;
30 travel cord;
31 housing;
32 channel;
33 joint.

VII. Detailed Description/Description of the Preferred Embodiment

The present invention is a combination of interconnecting parts that form a hands free hair drying system. The device includes an electric hair dryer head (10) that may be used with a variety of accessories, including a flexible arm (24), rigid pivot arm (29), and a base (22) and a travel cord (30).

The flexible arm (24), shown in FIGS. 1–4 and 11 is infinitely positionable and has a male connector (20) at one end and a female connector (21) at the other with electrical contacts (15) on each connector connected by wire (16) to conduct electricity from the base (22) or travel cord (30) through the insulated arm to the electric hair dryer head (10) without exposed wiring. The flexible arm may be constructed with a variety of types of gooseneck-type flexible tubing of metal or plastic. The flexible arm (24) may also have a support spine (25), shown in FIG. 3, through the center of the arm to provide additional support and rigidity.

Figure 4:
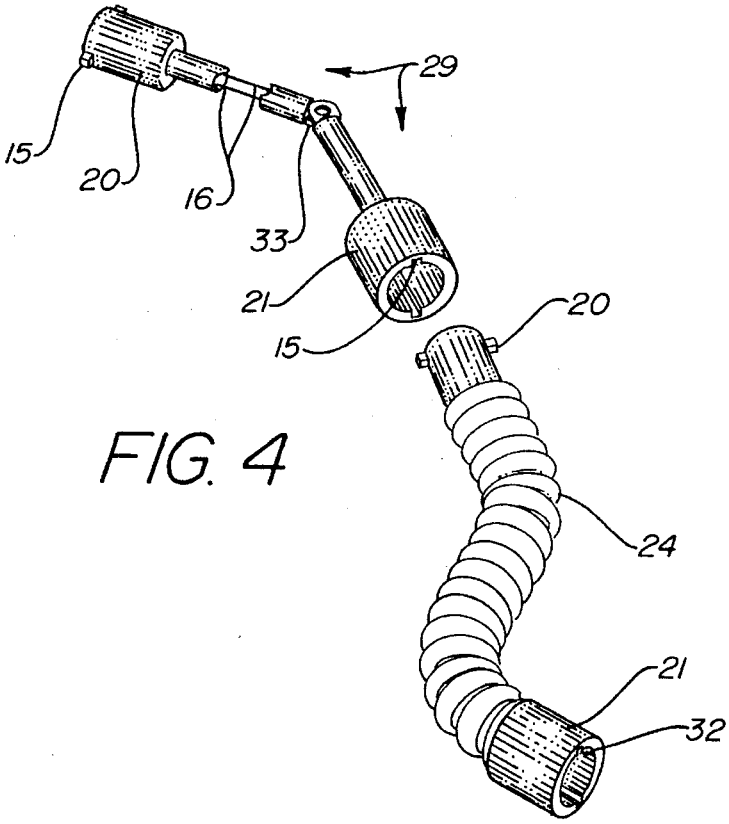
FIG. 4 is a perspective view of an additional pivot arm used to extend the reach of the flexible arm.

The rigid pivot arm (29), shown in FIG. 4, is similar to the flexible arm in design except that it is not infinitely flexible, but pivots or rotates around one or more joints (33). The rigid pivot arm (29) can conduct electricity through its electrical contacts (15), wires (16), a male connector (20) and a female connector (21) similar to the flexible arm (24). The rigid pivot arm (29) may be used in conjunction with the flexible arm (24) as shown in FIG. 4.

Figure 5:
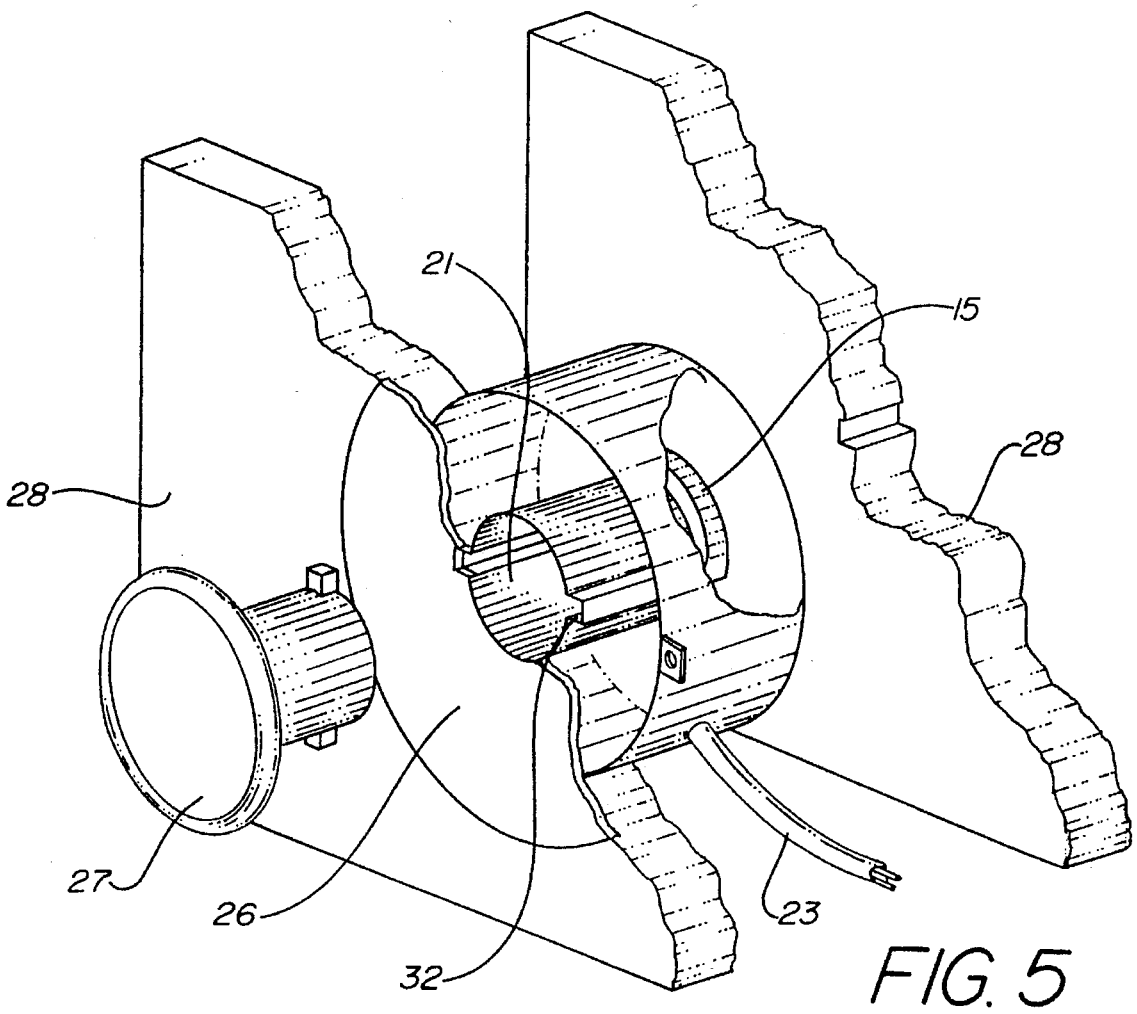
FIG. 5 is a perspective view of a flush-mount base installed in a wall.
Figure 6:
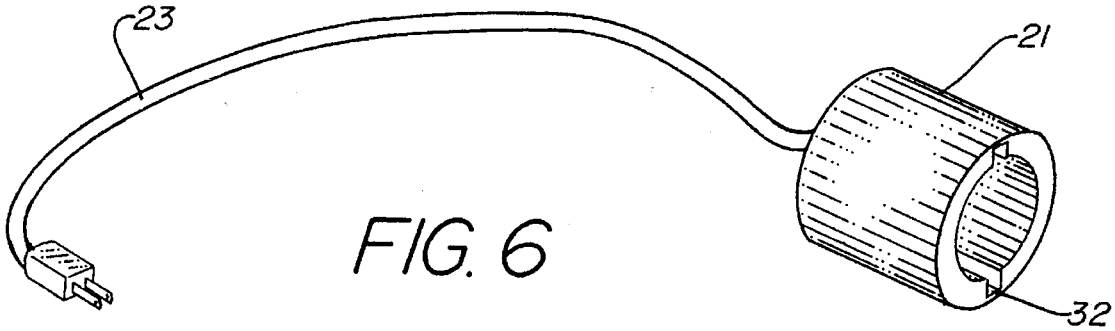
FIG. 6 is a perspective view of the removable power cord for use with the head alone.
Figure 8:
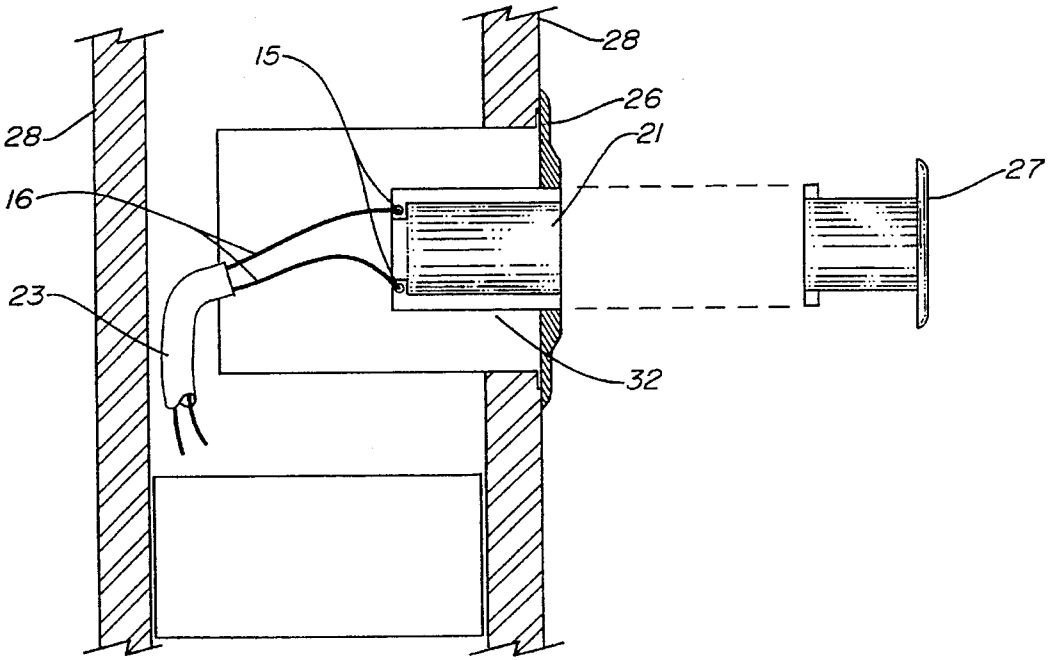
FIG. 8 is a cross section view of a flush-mount base.
Figure 9:
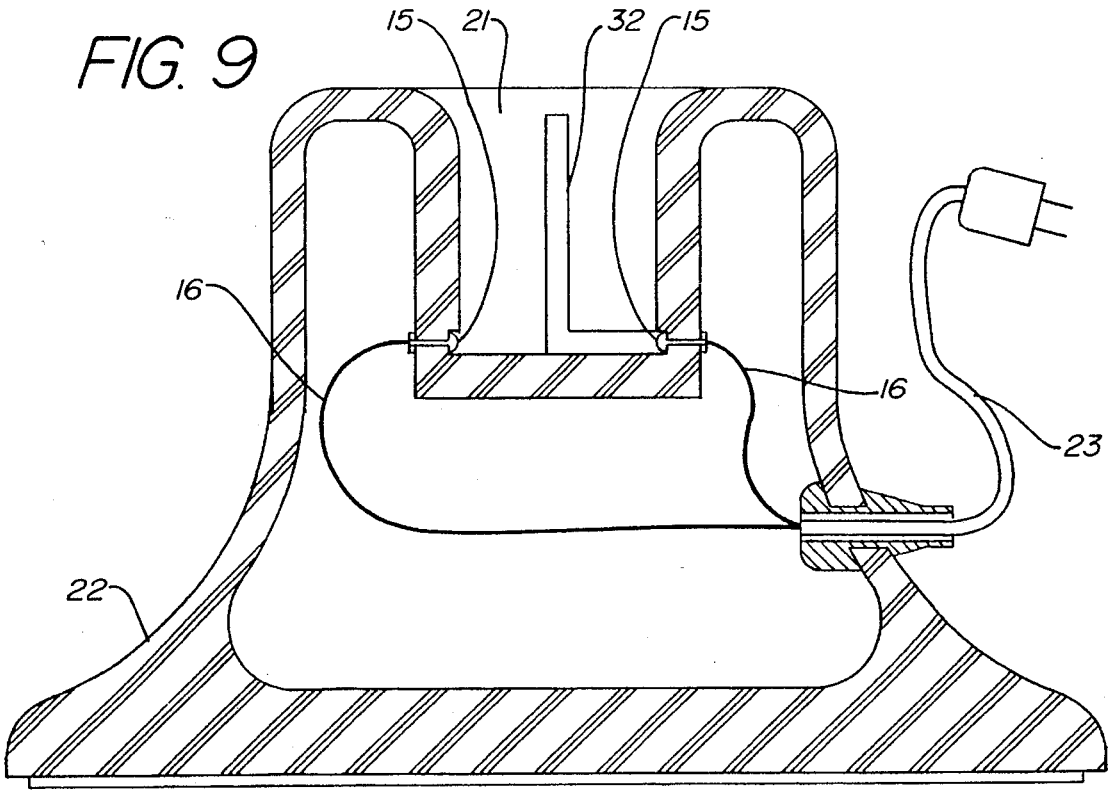
FIG. 9 is a cross section view of a table top base.
Figure 10:
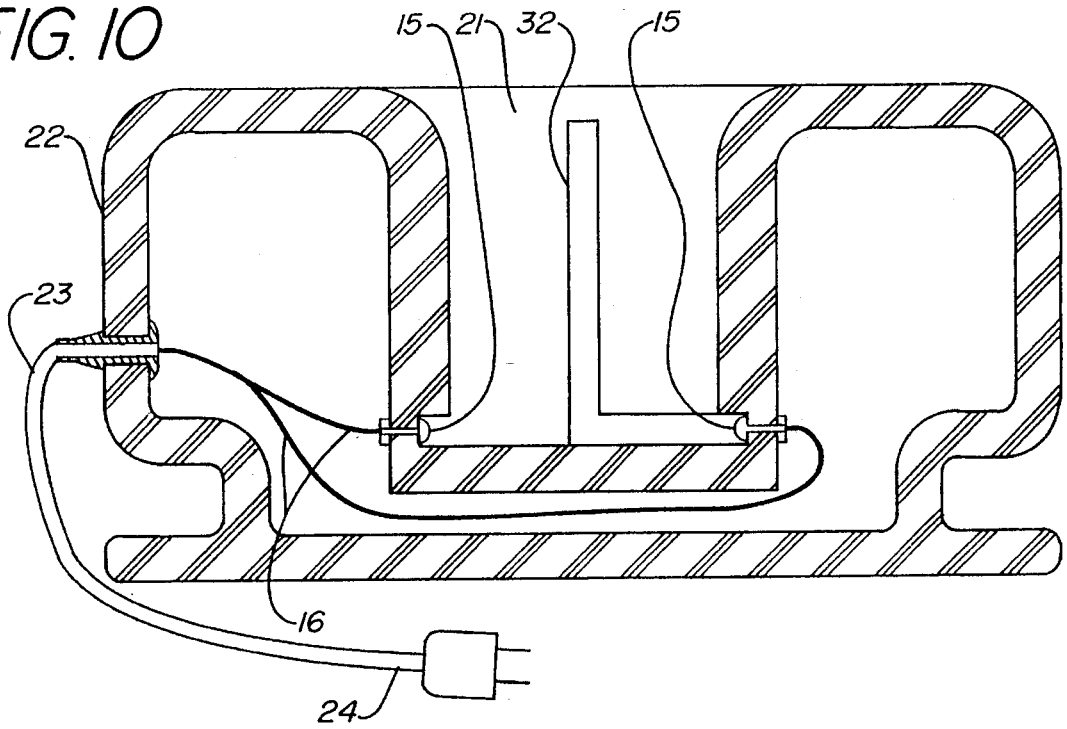
FIG. 10 is a cross section view of a surface-mount base.
Figure 11:
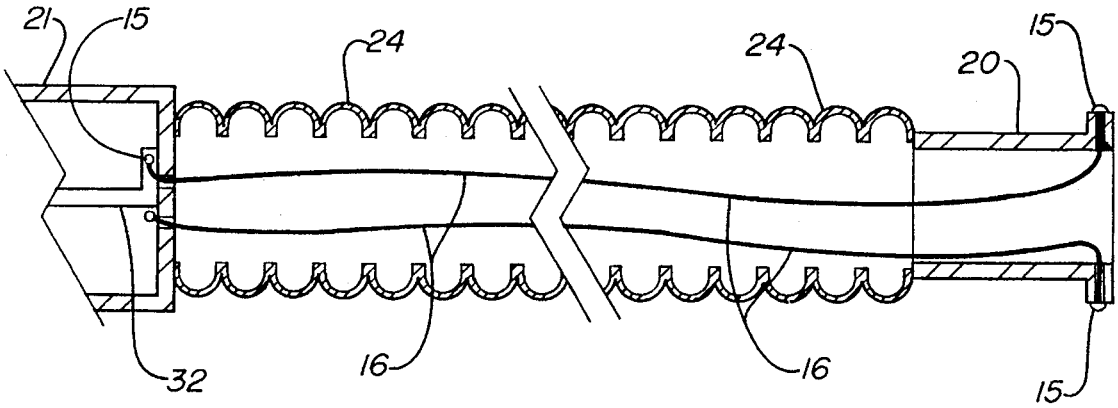
FIG. 11 is a cross section view of the flexible arm and connectors.
Figure 12:
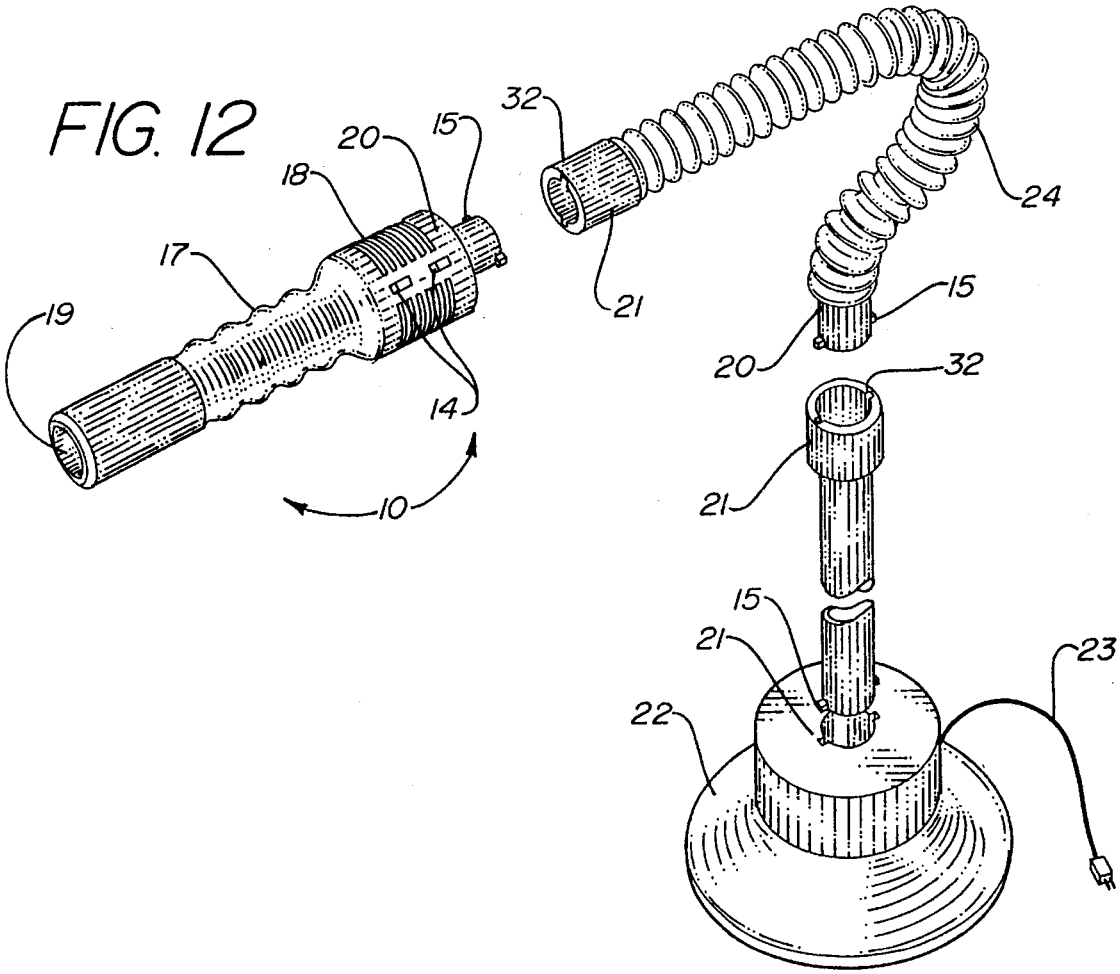
FIG. 12 is a perspective view of a floor stand base

The base (22) may be of four general types: a table top base, a wall surface-mount base, a wall flush-mount base or a floor stand base. The table top base (21), shown in FIGS. 2 and 9, may be in a variety of decorative shapes. The wall surface-mount base (21), shown in FIGS. 1 and 10, is designed to be hung on a wall without permanent installation. The surface-mount base may allow for the coiling of the power cord (23) around the base or to be retracted on a reel inside the base. The wall flush-mount base (21), shown in FIGS. 5 and 8, is intended for permanent installation in a wall (28) with direct wiring to the household electrical system. The flush-mount base has a face plate (26) covering the edge of the hole in the wall (28). When the base is not in use, the female connector (21) may be covered with a protective cover (27) to prevent accidental electrical shock. The protective cover (27) may be ornamental or may include a hangar to hang some other decorative item such as a picture to hide the base (22) and face plate (26). The floor stand base (22) is shown in FIG. 12.

Figure 7:
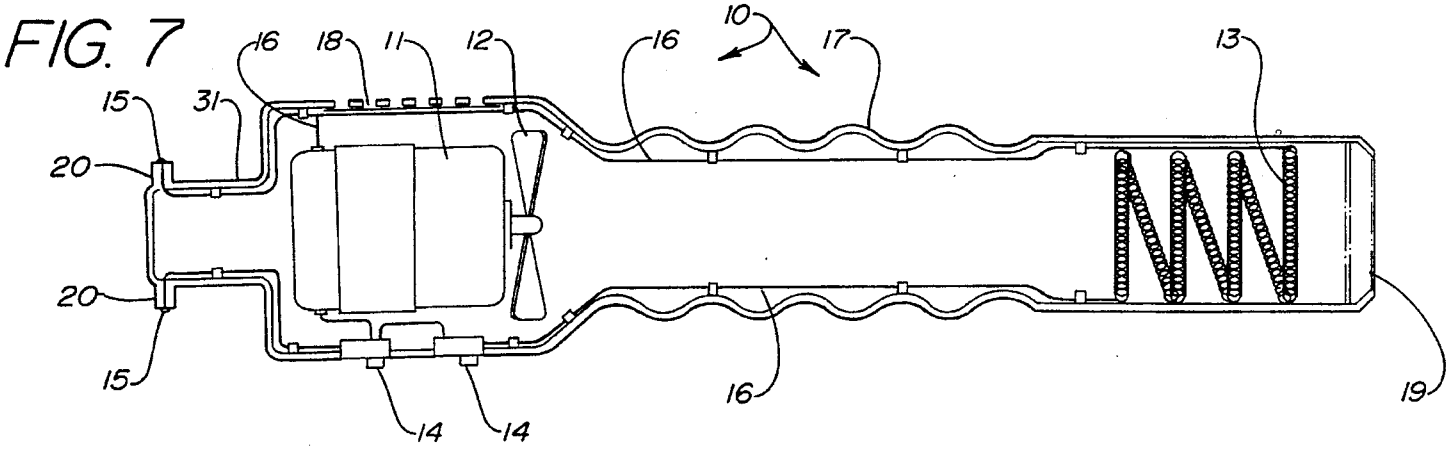
FIG. 7 is a cross section view of a the electric hair dryer head.

As shown in FIG. 7, the electric hair dryer head (10) includes a motor (11) with a fan (12) attached to its shaft. A heating element (13) heats air that is drawn into the electric hair dryer head (10) through the air intake (18) by the fan (12) and then forced over the heating element (13) before exiting through the air exhaust (19). The motor (11 ) and fan (12) are controlled by one or more switches (14) within the circuits between the electrical contacts (15) in the male connector (20). The housing (31) of the electric hair dryer head (10) is molded to form a grip (17) for easy handling by the user. The housing (31) for the electric hair dryer head (10) may be manufactured by conventional injection molding of suitable thermoplastic materials.

The electrical contacts (15) of the male connector (20) in the preferred embodiment enter channels (32) of the female connector (21) and then rotate to provide a bayonet-type connection. The electrical contacts (15) of the female connector (21) are recessed to prevent a user from accidentally touching the electrical current. Other equivalent connectors may also be used.

VIII. Claims

What is claimed is:

1. A hair dryer, comprising an electrical hair dryer head comprising a housing forming an air intake and an air exhaust, with said housing enclosing a motor, a fan, a heating element, a means for controlling said motor, and a means for controlling said heating element, said housing also having a male connector, and a means for conducting electricity through said male connector of said hair dryer head to said means for controlling said heating element and said means for controlling said motor, a base with a female connector and a means of conducting electricity through said female connector of said base to a male connector; and a flexible arm, said arm being bendable into a user selectable shape and being adapted to support said hair dryer head in a desired position, said arm having a male connector that may be detachably secured to said female connector of said base, a female connector that may be detachably secured to said male connector of said hair dryer head, and means for conducting electricity through said male connector of said arm to said female connector of said arm.

2. A hair dryer as defined in claim 1, wherein said arm is infinitely positionable.

3. A hair dryer as defined in claim 1, wherein said base comprises a table-top base, said table-top base having a horizontal, planar bottom face for supporting said hair dryer on a surface and having a top face with an aperture extending therethrough for providing access to said female connector of said base.

4. A hair dryer as defined in claim 1, wherein said base comprises a wall surface-mount base, said wall surface-mount base having a vertical rear face for securing to a wall, a vertical front face having an aperture extending therethrough for providing access to said female connector of said base, and sides, said sides having a groove formed therein to help retain a power cord that may be coiled around said sides.

5. A hair dryer as defined in claim 1, wherein said base comprises a wall flush-mount base, said wall flush-mount base having a vertical front face having an aperture for providing access to said female connector of said base and said wall flush-mount base having a vertical face plate affixed to said front face and having an aperture passing therethrough that is aligned with said aperture of said front face to provide access to said female connector of said base.

6. A hair dryer as defined in claim 1, wherein said arm further comprises:

a plurality of pivotally secured rigid members extending between and connecting said male and female connectors of said arm, and an outer cover extending between and connecting said male and female connectors of said arm said means for conducting electricity through said male connector of said arm to said female connector of said arm and said plurality of rigid members being disposed within said outer cover.

7. A hair dryer as defined in claim 1, further comprising:

a rigid, vertically disposed extension member, said extension member having a male connector at a lower end that may be detachably secured to said female connector of said base, a female connector at an upper end that may be detachably secured to said male connector of said arm, and means for conducting electricity through said male connector of said extension member to said female connector of said extension member.

8. A hair dryer as defined in claim 1, wherein said base comprises a wall surface-mount base, said wall surface-mount base having a vertical rear face for securing to a wall, a vertical front face having an aperture extending therethrough for providing access to said female connector of said base, and a reel disposed in an inner compartment of said base for storing a portion of a coiled power cord within said base.

9. A hair dryer, comprising:

a base having a first electrical connector adapted for connecting to a source of electricity, a second electrical connector, and electrical conductors extending between and operatively connecting said first and second electrical connectors of said base;

an electrical hair dryer head having a housing, a motor disposed within said housing, a fan disposed within said housing and being operatively connected to said motor to be driven by said motor, and an electrical connector affixed to said housing and being operatively connected to said motor for providing an electrical current to said motor; and a flexible arm, said arm being bendable into a user selectable shape and being adapted to support said hair dryer head in a desired position, said arm having a first electrical connector that may be detachably secured to said second electrical connector of said base, a second electrical connector that may be detachably secured to said electrical connector of said hair dryer head, and electrical conductors extending between and operatively connecting said first and second electrical connectors of said arm.

10. A hair dryer as defined in claim 9 wherein said electrical conductors of said base and said arm are insulated wires.

11. A hair dryer as defined in claim 9 wherein said first electrical connector of said arm is a male connector and said second electrical connector of said arm is a female connector.

12. A hair dryer as defined in claim 9 wherein said arm further comprises:

a plurality of pivotally secured rigid members extending between and connecting said first and second electrical connectors of said arm, and an outer cover extending between and connecting said first and second electrical connectors of said arm, said electrical conductors of said arm and said plurality of rigid members being disposed within said outer cover.

13. A hair dryer as defined in claim 9, further comprising an extension member having a first electrical connector at a lower end that may be detachably secured to said second connector of said base, a second electrical connector at an upper end that may be detachably secured to said first electrical connector of said arm, and electrical conductors extending between and operatively connecting said first and second electrical connectors of said extension member.

14. A hair dryer as defined in claim 13, wherein said extension member is rigid and is adapted to extend substantially vertically.

* * * * *

UNITED STATES PATENT AND TRADEMARK OFFICE

CERTIFICATE OF CORRECTION

PATENT NO : 5,592,749

DATED : January 14, 1997

INVENTOR(S) : Karen Trimmer

It is certified that error appears in the above-identified patent and that said Letters Patent are hereby corrected as shown below:

In column 1, line 3, "(if any)," should be--(if any).--.

In column 1, line 59, a new paragraph should begin after "Drawings".

In column 4, line 26, (line 7 of claim 6), a comma should be inserted after "arm".

Signed and Sealed this

Eighth Day of April, 1997

Bruce Lehman

*Attest:*

BRUCE LEHMAN

*Attesting Officer*

*Commissioner of Patents and Trademarks*